United States Patent [19]

Pierrel

[11] 4,116,260

[45] Sep. 26, 1978

[54] INSTALLATION FOR THE CENTRIFUGAL CASTING OF LARGE PIPES

[75] Inventor: Michel Pierrel, Pont-a-Mousson, France

[73] Assignee: Pont-A-Mousson S.A., Nancy, France

[21] Appl. No.: 784,878

[22] Filed: Apr. 5, 1977

[30] Foreign Application Priority Data

Apr. 13, 1976 [FR] France ..... 76 10800

[51] Int. Cl.[2] ..... B22D 13/10

[52] U.S. Cl. ..... 164/295; 164/297; 164/298; 164/301; 164/302

[58] Field of Search ..... 164/175, 176, 178, 180, 164/181, 289, 290, 293, 295, 296, 297, 298, 299, 300, 301, 302, 286; 308/DIG. 1; 425/435

[56] References Cited

U.S. PATENT DOCUMENTS

| | | | |
|---|---|---|---|
| 2,023,040 | 12/1935 | Adams | 164/298 |
| 2,073,200 | 3/1937 | Dumas | 164/296 |
| 3,103,364 | 9/1963 | Macks et al. | 308/DIG. 1 |
| 3,438,427 | 4/1969 | Lorang | 164/295 |
| 3,457,986 | 7/1969 | Andrews | 164/298 X |
| 3,587,712 | 6/1971 | Dearden | 164/298 X |
| 3,716,094 | 2/1973 | Fuminier | 164/297 X |
| 3,818,974 | 6/1974 | Eberle | 164/289 X |
| 4,049,043 | 9/1977 | Fort | 164/295 |

*Primary Examiner*—Francis S. Husar
*Assistant Examiner*—John S. Brown
*Attorney, Agent, or Firm*—Sughrue, Rothwell, Mion, Zinn and Macpeak

[57] ABSTRACT

The installation comprises two centrifugal casting moulds which are roughly parallel to each other and are movable by rotation of a common support between a mould preparing station, a pouring station and a pipe extracting station, which stations are disposed in such maner that one of the moulds is in the axial extension of the pouring station when the other mould is in the axial extension of the extracting station and vice-versa. The two moulds are carried by rollers mounted on the common support and the latter comprises a horizontal platform which is rotatable about a central vertical axis relative to which the two moulds are symmetrically arranged.

7 Claims, 7 Drawing Figures

A
-8-
-8-
10a
10b
11a
11b
B1
B2
S1
S2
W1
W2
N1
4
9
15
16
17
19
20
21
22
24
25
26
27
28
29
30
31
1
C

INSTALLATION FOR THE CENTRIFUGAL CASTING OF LARGE PIPES

The present invention relates to installations for the centrifugal casting of large pipes of the type comprising two centrifugal casting machines having parallel moulds of the de Lavaud type, that is to say machines having a pouring trough and a relative movement of translation between the trough and the centrifugal casting mould.

It is more particularly but not exclusively applicable to the manufacture of cast iron pipes having a socket.

Centrifugal casting machines are known which have parallel moulds which operate in pairs and permit eliminating a part of the lost times by effecting the operations for preparing the moulds and the pouring trough (cleaning and coating) on one mould while the casting and the extraction of the moulded pipe are effected on the other. They also have the advantage of simplifying the stations for pouring and coating the mould, since a single station is capable of moving in translation between two machines for serving each one thereof in turn.

However, it has been possible up to the present time to utilize only one extracting station, that is to say a station for removing the cast pipes from the moulds which is also movable in translation between the machines, owing to the magnitude of the extracting forces necessary and the difficulty of mounting a movable extracting station between the two machines.

Moreover, bearing in mind that whereas the last droplets of cast iron have been poured into the mould of one of the machines this mould must still rotate a certain period of time before the extraction of the cast pipe so as to allow the pipe to cool until it reaches a rather solid and rigid state to permit the extraction, and bearing in mind that this further period of rotation of the mould is relatively long and constitutes an unemployed period of time for the other machine of the pair which must wait to receive the poured metal, there still exists a lost period of time.

Furthermore, the known installations in which a pair of machines are moved in translation require rails which require servicing and have the drawback of causing the equipment to undergo shocks and vibrations in the course of the movements in translation.

Moreover, there is known from the French Pat. No. 1,587,293 an installation for centrifugal casting comprising two centrifugal casting moulds which are parallel to each other and which are movable by rotation of a common support between stations for preparing the mould, for pouring the metal and for extracting the pipe, and are disposed in such manner that one of the moulds is in the axial extension of the pouring station when the other mould is in the axial extension of the extracting station and vice versa. However, this installation is suitable neither for the manufacture of pipes having a socket which require the mounting of cores, nor for the manufacture of large pipes since the support rotates about a horizontal axis.

Therefore, an object of the present invention is to provide an installation of the type having two machines whose moulds are parallel and a single pouring station whereby it is possible to manufacture in series at a high rate large cast iron pipes which may have if desired a socket.

According to the invention, there is provided an installation comprising two centrifugal casting moulds which are roughly parallel to each other and movable by rotation on a common support between the stations for preparing the mould, for pouring the metal and for extracting the pipe, which are disposed in such manner that one of the moulds is in the axial extension of the pouring station when the other mould is in the axial extension of the pipe extracting station and vice versa, wherein the two moulds are carried by rollers mounted on the common support and the common support comprises a horizontal platform which is mounted to rotate about a central vertical axis which is an axis of symmetry for the two moulds.

Note that the invention is essentially applicable to the case of large machines for casting pipes which are from 6 to 9 meters long and have diameters which are of several tens of centimeters and may exceed 1 meter.

Further features and advantages of the invention will be apparent from the ensuing description which is given merely by way of example with reference to the accompanying drawings in which.

Figures 1, 2, 3, 7:
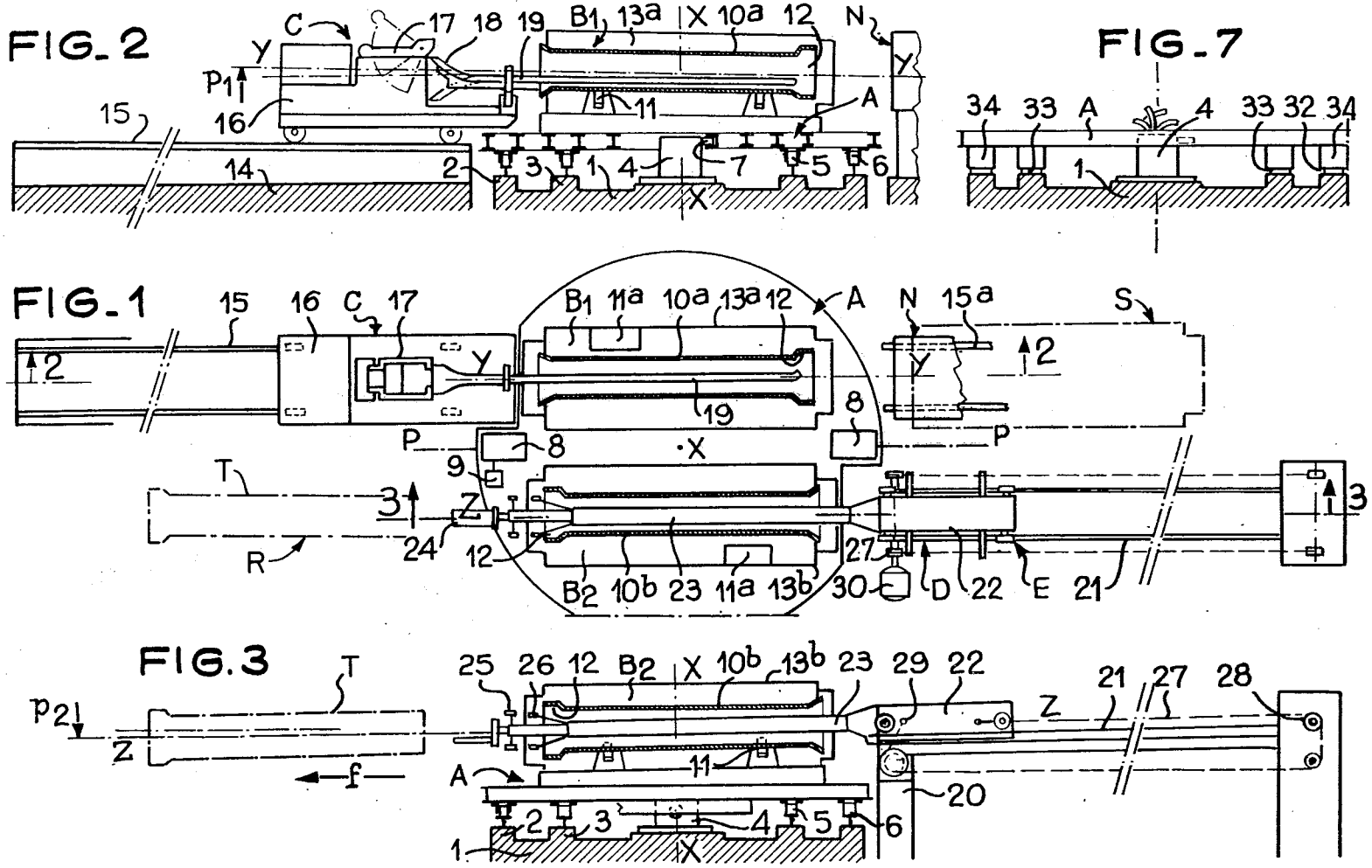
FIG. 1 is a diagrammatic plan view of an installation for the centrifugal casting of cast iron pipes according to the invention.
FIG. 2 is a diagrammatic elevational and sectional view taken on line 2—2 of FIG. 1, of one of the machines at the metal pouring station.
FIG. 3 is a diagrammatic elevational and sectional view taken on line 3—3 of FIG. 1, of the other machine at the coating and extracting station.
FIG. 7 is a partial detail view of a modification of the rotatable platform mounted on a fluid cushion.
Figures 4, 5, 6:
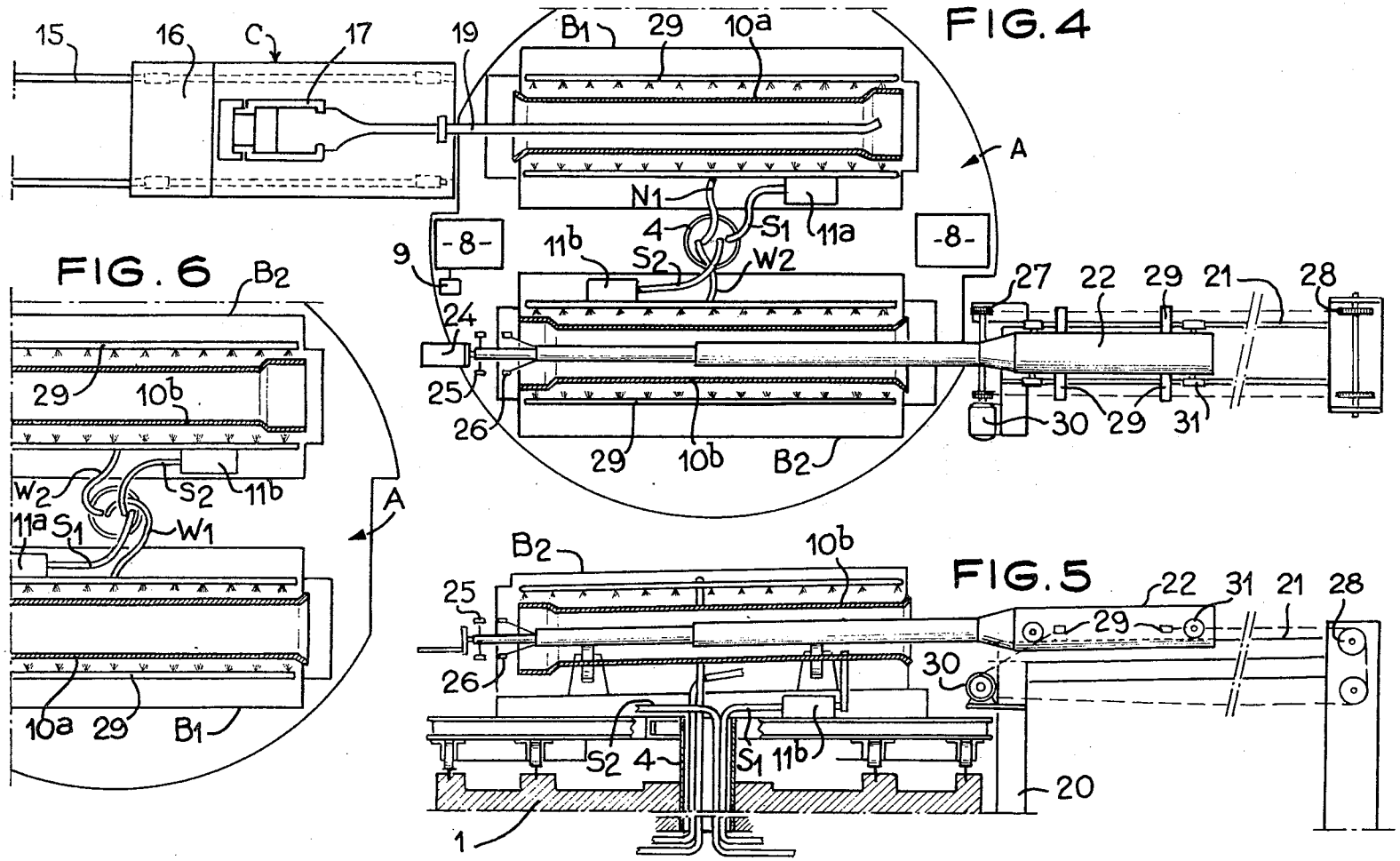
FIG. 4 is a partial view corresponding to FIG. 1 to an enlarged scale, illustrating the supply lines of the two machines.
FIG. 5 is a view corresponding to FIG. 3 to the same scale as FIG. 4, illustrating the supply lines in elevation.
FIG. 6 is a plan view similar to FIG. 4 illustrating the supply lines after rotation of the two machines through 180° around the central pivot.

The installation shown in FIGS. 1 to 6 comprises, in the center thereof, a rotatable platform A carrying two centrifugal casting machines $B_1$ and $B_2$ having rotatable moulds mounted in reverse directions, a pouring station C mounted on a track disposed in the extension of one machine of the rotatable platform A, and a station N for mounting and locking a core and disposed in the extension of said track on the other side of the machine, a station D for preparing the moulds, that is cleaning and coating them, and a station E for extracting the pipe which are mounted on a second track disposed in the extension of the other machine of the rotatable platform A.

The rotatable platform A has a circular shape and an axis X—X and is mounted on a solid mass 1 forming a support and having two concentric runway rings 2 and 3 having an axis X—X and each carrying a circular rail. Mounted on the centre of this mass 1 is a pivot 4 having an axis X—X which in fact does not act as a support for the platform A but as a guide and centring means for the platform A by its cylindrical surface. The platform A proper comprises two sets of support rollers 5 and 6 having horizontal axes which roll respectively on the rings 2 and 3 (each set containing for example three or four rollers) and a guide roller 7 having a vertical axis which rolls on the cylindrical surface of the pivot 4. Some of the rollers 5 and 6 are driving rollers and are driven in rotation by a motor 8. In the presently described embodiment there are two diametrally opposed motors 8 (FIG. 4) and four driving rollers 5 and 6. The rotatable platform A is moreover provided with an indexing device 9 whereby the platform can pivot through 180° and then stop.

The centrifugal casting machines $B_1$ and $B_2$ disposed on the platform A carry centrifugal casting moulds 10$^a$ and 10$^b$ having axes of rotation Y—Y and Z—Z which are in the neighborhood of the horizontal and are not exactly parallel to each other but contained in parallel vertical planes, the axis Y—Y of the mould 10$^a$ being slightly inclined at a certain slope $p^1$ whereas the axis Z—Z of the mould 10$^b$ is slightly inclined at the same slope $p^2$ but in the opposite direction. These machines $B_1$ and $B_2$ are mounted in reverse directions symmetrically with respect to the vertical axis X—X, whence the symmetrical character of the inclinations of the axes Y—Y and Z—Z. The moulds 10$^a$ and 10$^b$ are rotatable about their respective axes Y—Y and Z—Z owing to the provision of rollers 11 and motors 11$^a$. In the presently described embodiment, each mould comprises an end having a socket forming end 12. These machines $B_1$ and $B_2$ are of conventional type and are consequently very briefly diagrammatically represented by their fixed case 13$^a$ or 13$^b$ which is capable of being dismantled and surrounds the rotatable moulds 10$^a$ and 10$^b$ and contains the driving motors 11$^a$, 11$^b$ and the conventional cooling device for each mould.

The central pivot 4 carried by the mass 1 is tubular and serves as a sheath (FIG. 4) for the supply lines for the two machines supplying cooling water to the moulds 10$^a$ and 10$^b$ and supplying electricity for driving the motors 8, 11$^a$–11$^b$ and supplying current to other associated electrical means. The water pipe lines are divided into two flexible pipes $W_1$ and $W_2$ for supplying water to the water spraying system 29 of the machines $B_1$ and $B_2$. The flexible and supple electric lines are for example two in number, namely $S_1$ and $S_2$ for supplying current to the motors 8. They may be more numerous and even constitute a bunch of flexible lines.

The pouring station C is mounted on a frame 14 forming a support and comprises (FIG. 2) a runway track 15 in the extension of which either of the centrifugal casting machines is capable of being placed, the machine $B_1$ in the position shown in FIG. 2, this track having moreover the same inclination $p^1$ as this machine. This track 15 is parallel to a vertical main plane of symmetry P—P containing the axis X—X of the rotatable platform A. Capable of rolling along this track is a carriage 16 carrying a tiltable pouring ladle 17, the control mechanism therefor, a pouring spout 18 and a pouring trough 19 for pouring the molten iron. The carriage 16 is made to travel in translation in such manner as to be capable of inserting the pouring trough 19 inside the mould 10$^a$ or 10$^b$ and pouring the molten iron during the rotation of the mould, throughout the length of the latter, by starting at the socket end 12 which is at the end remote from the carriage 16.

On another track 15$^a$ forming a support and located in the extension of the track 15 and on the other side of the machine $B_1$, there is provided the station N for mounting the socket cores, that is to say the station at which a core is introduced and locked into the socket-forming end 12 in order to give the internal shape of the socket of the pipe cast. Moreover, there may be unloaded onto this track 15$^a$ the case or cowling 13$^a$ or 13$^b$, or even the two cases for servicing or repairs of each machine. This track 15$^a$ is therefore also a track for storing the cowlings.

The coating station D is mounted on a frame 20 forming a support and comprises (FIG. 3) a runway track 21 in the extension of which the other machine $B_2$ or $B_1$ is capable of being placed and which is of the same inclination $p^2$ as this other machine and therefore inclined in the opposite direction to the track 15 opposed to the pouring station and disposed symmetrically with this track with respect to the axis X—X. The coating to be deposited in the mould is for example a coating of silica and bentonite in suspension in water. The coating apparatus, carried by an extracting carriage 22 movable along the track 21, is of known type including guns carried at the end of a rod and it is illustrated diagrammatically at the end of the rod 23 by a rectangle 24 representing an assembly of guns having different orientations. It also comprises cleaning brushes 25 placed in such manner as to be operative before the guns. By way of example, this apparatus for effecting a wet spray can be of the type described in French Pat. Nos. 75. 16 632 and 75. 18, 605 filed by the applicant. The carriage 22 is made to move in translation so as to insert the guns 25 into the moulds 18$^a$ and 18$^b$ and coat the wall with a refractory coating of white colour during the rotation of the mould, throughout the length of the latter, by starting at the socket end 12 which is the end remote from the carriage 22.

The extracting station E is mounted on the frame 20 and on the same track 21 as the coating station D, and it is of the thrust type and comprises expansible claws or jaws 26 which are adapted to engage inside a pipe to be extracted and are mounted on the carriage 22 which is shifted by a device 27 including chains which extend around guide and direction-changing wheels 28 and are hooked to lugs 29 on this carriage. The pair of wheels 27 adjacent the rotatable platform A is driven in rotation by a motor 30. The wheels 31 whereby the carriage 22 rolls along the track 21 have horizontal axes located in a plane passing through the axis Z—Z of the mould 10$^a$ or 10$^b$ which is the thrust axis. In this way, parasitic forces are avoided and the thrusting function of the carriage 22 is facilitated. Wear is also reduced. In the Figures, the extracting device is shown at the end of its travel.

The installation just described operates in the following manner:

Let is be assumed that the casting machine $B_1$ is at the pouring station C (FIGS. 1 and 2) and that the casting machine $B_2$ is at the coating station D and extraction station station E (FIGS. 1 and 3). The machine $B_1$ is ready to receive a core and then the liquid iron, whereas the machine $B_2$ contains a previously-cast pipe and is ready to receive the thrusting extractor 22 and then the apparatus 24–25 for cleaning the mould 10$^b$ and effecting the wet spray.

At station N, on the track 15$^a$, in the extension of the track 15 and at the other end of the machine $B_1$, a socket core is introduced and locked into the socket 12.

During this time, at station C, the carriage 16 for pouring the metal starts to move toward the machine $B_1$ and then progressively introduces the trough 19 into the latter until the end of this trough reaches the end of the socket 12 of the rotated mould 10$^a$ and, as the pouring proceeds, the carriage 16 moves rearwardly to cause the stream of molten iron to travel along the entire length of the mould 10$^a$. At the end of the pouring, the mould 10$^a$ still rotates a few instants at the speed of centrifugal casting until the cast pipe has reached a temperature which is low enough to enable the pipe to be extracted, this temperature being ascertained by its color.

Simultaneously, at station E, the extracting carriage 22 approaches the machine $B_2$ and causes its jaws to engage inside the previously cast pipe and then thrusts the latter in the direction of arrow *f* away from the stations D and E and disengages the pipe from the mould $10^b$ along the axis Z—Z to the cast pipe receiving region R (position of the pipe T shown in dot-dash lines). At the end of this extraction, the carriage 22 is located in the illustrated position and is ready to allow the wet spray apparatus to operate.

This carriage 22 then returns the cleaning brushes 25 and the guns 24 carried at the end of the rod 23 to the socket 12 of the mould $10^b$, this rearward movement being simultaneous with the rotation of the mould at the centrifugal casting speed. The mould $10^b$ is thus cleaned in the dry condition and, immediately following on the brushing, the wet spray coating is applied by the effect of centrifugal force on the entire length of the wall of the mould $10^b$. At the end of the coating operation, the carriage 22 is located in the position for recommencing the extracting operation on the other machine.

When these operations, which constitute a semi-cycle, have finished for the machines $B_1$ and $B_2$, the rotatable platform A turns through 180° about the pivot 4 by rolling along the rings 2 and 3 and while it is guided on the pivot 4 by the roller 7. In the course of this rotation, the lines $W_1$ and $W_2$ and $S_1$ and $S_2$, owing to their flexibility and length, follow the movement of the respective machines $B_1$ and $B_2$ while they twist (FIG. 6), bearing in mind that, in the course of the pivoting in opposite direction, they will resume their position shown in FIG. 5. The platform A stops when it has placed the machine $B_2$ on the axis Y—Y and the machine $B_1$ on the axis Z—Z.

The same procedure then starts for the machine $B_2$ which is ready to receive the liquid iron and the machine $B_1$ which is ready to receive the extracting device 22 and then the apparatus 24–25 for cleaning the mould and effecting the wet spraying thereof which constitutes the second semi-cycle. At the end of this second semi-cycle, the platform A rotates through 180° in the opposite direction and returns to its initial position.

This installation has the following advantages, among others.

Owing to its symmetrical arrangement, to its platform rotating about the pivot 4 having an axis X—X and to the reverse arrangement of the machines $B_1$ and $B_2$, this installation comprises a single station N for mounting and locking cores, a single station C for pouring, a single coating station D and a single extracting station E, the whole being sufficient for the two large casting machines $B_1$ and $B_2$.

In the course of pipe manufacture, that is to say in operation, the installation enables operations to be carried out simultaneously on the machines $B_1$ and $B_2$ practically without loss of time, the sole stoppages in the operations corresponding to the rotations of the platform A through 180° alternately in one direction and then the other. Consequently, the rate of production of the cast iron pipes is increased.

The alternating rotations through 180° enable the lines $W_1$–$W_2$–$S_1$–$S_2$ to follow the movements of the machines that is to say the rotations thereof. Consequently, the supply lines are simplified as no rotating joint is necessary and the wear of the lines is reduced.

For servicing purposes, it is easy to mount the case $13^a$ of the machine $B_1$, or the case $13^b$ of the machine $B_2$, on the track $15^a$ which permits overhauling and servicing the moulds $10^a$ and $10^b$ while leaving them on the casting machines. The case $13^a$ is shown in dot-dash lines at the mould case receiving station S in FIG. 1.

Owing to the possibility of dismantling and placing the cases $13^a$ and $13^b$ of the casting machines for example on the track $15^a$ provided for this purpose, the moulds $10^a$ and $10^b$ may be serviced on the spot without removing them from the machines $B_1$ and $B_2$ so that the delicate operations of disassembly, handling with an overhead rolling crane, and reassembly of the moulds $10^a$ and $10^b$ are advantageously avoided.

A large amount of space is saved since in known installations each machine requires two parallel tracks for the pouring, wet spray and extracting carriages.

In the modification shown in FIG. 7, the platform A, instead of rolling on the two circular rails 2 and 3, rotates on fluid cushions. There may be employed air cushions or, better still, water cushions which require much less energy. For this purpose, the rings 2 and 3 of the mass 1 are provided with two perfectly planar annular plates 32 and 33 which are concentric on the axis X—X and with which there cooperate nozzles having skirts 34 carried by the rotating platform A. A sustaining fluid is blown through these nozzles and interposed between the platform A and the plates 32 and 33.

Owing to this handling on fluid cushions, and as compared to the previous mounting employing rolling rails, there is a reduction in the vibrations and in the energy required for rotating the platform A and in the forces exerted on the mass 1. Wear is avoided since there is no longer any friction between the platform A and the support mass 1.

It must be understood that the invention is applicable to machines for centrifugally casting pipes having two cylindrical smooth male ends which are therefore devoid of a socket or a socket core, or pipes having one or two ends of a particular shape other than that of a socket. In the first case, the station N is eliminated.

I claim:

1. An installation for the centrifugal casting of large heavy pipes comprising on means defining a support, a horizontal platform mounted to be rotatable about a vertical axis, two centrifugal casting machines mounted on the platform and comprising rotative moulds each of which moulds has a pipe socket-forming end, the moulds having axes of rotation which are respectively contained in a first plane and a second plane which are parallel to each other and to said vertical axis and disposed on opposite sides of said vertical axis, the two moulds being in alignment transversely of said axes of rotation of the moulds in a direction substantially perpendicular to said two planes and arranged in opposite directions on the platform symmetrically relative to said vertical axis, a first station comprising mould preparing means and pipe extracting means, a cast pipe receiving region, a second station comprising means for pouring casting metal into the moulds, a third station comprising means for mounting a core in the pipe socket-forming end of the moulds, means combined with the platform for driving the platform in rotation about said vertical axis between a first casting position and a second casting position at 180° to said first position, said first station and said casting pipe receiving region being on opposite sides of the platform and contained in a third vertical plane and said second station and said third station being on opposite sides of the platform and contained in a fourth vertical plane, said first plane and third plane being coplanar and said second plane and fourth plane being coplanar in said first position of the platform and said second plane and third plane being coplanar and said first plane and said fourth plane being coplanar in said second position of the platform, and said pipe extracting means being positioned and operative to extract the cast pipe by pushing the cast pipe through the mould toward said cast pipe receiving region.

2. An installation as claimed in claim 1, comprising a first track and a second track in said fourth plane, the first track carrying the pouring means and the second track carrying the core mounting means.

3. An installation as claimed in claim 2, wherein each centrifugal casting machine comprises a detachable case surrounding the corresponding mould, it being possible to support the case after detachment thereof on said second track which also constitutes a case receiving station.

4. An installation as claimed in claim 1, comprising a track in said third plane, the extracting and mould preparing means being carried by said track.

5. An installation as claimed in claim 1, further comprising fluid cushion means rotatively supporting the platform on said support.

6. An installation for the centrifugal casting of large heavy pipes comprising on means defining a support, a horizontal platform mounted to be rotatable about a vertical axis, two centrifugal casting machines mounted on the platform and comprising rotative moulds each of which moulds has a pipe socket-forming end, the moulds having axes of rotation which are respectively contained in a first plane and a second plane which are parallel to each other and to said vertical axis and disposed on opposite sides of said vertical axis, the two moulds being in alignment transversely of said axes of rotation of the moulds in a direction substantially perpendicular to said two planes and arranged in opposite directions on the platform symmetrically relative to said vertical axis, a first station comprising mould preparing means and pipe extracting means, a cast pipe receiving region, a second station comprising means for pouring casting metal into the moulds, a third station comprising means for mounting a core in the pipe socket-forming end of the moulds, means combined with the platform for driving the platform in rotation about said vertical axis between a first casting position and a second casting position at 180° to said first position, said first station and said cast pipe receiving region being on opposite sides of the platform and contained in a third vessel plane and said second station and said third station being on opposite sides of the platform and contained in a fourth vertical plane, said first plane and third plane being coplanar and said second plane and fourth plane being coplanar in said first position of the platform and said second plane and third plane being coplanar and said first plane and said fourth plane being coplanar in said second position of the platform, and said pipe extracting means being positioned and operative to extract the cast pipe by pushing the cast pipe through the mould toward said cast pipe receiving region, the platform being rotatably mounted on said support by means comprising a fixed hollow pivot disposed on said vertical axis of rotation and flexible cooling water and electric current supply lines directly connected to the casting machines extending through said hollow pivot, said means driving the platform in rotation about said vertical axis being operative to drive the platform in a given direction between said first position and said second position and in an opposite direction between said second position and said first position whereby no rotating joints are required in said supply lines.

7. An installation for the centrifugal casting of large heavy pipes comprising on means defining a support, a horizontal platform mounted to be rotatable about a vertical axis, two centrifugal casting machines mounted on the platform and comprising rotative moulds having axes of rotation which are respectively contained in a first plane and a second plane which are parallel to each other and to said vertical axis and disposed on opposite sides of said vertical axis, the two moulds being in alignment transversely of said axes of rotation of the moulds in a direction substantially perpendicular to said two planes and arranged on the platform symmetrically relative to said vertical axis, a first station comprising mould preparing means and pipe extracting means, a second station comprising means for pouring casting metal into the moulds, means combined with the platform for driving the platform in rotation about said vertical axis between a first casting position and a second casting position at 180° to said first position, said first station being contained in a third vertical plane and said second station being contained in a fourth vertical plane, said first plane and third plane being coplanar and said second plane and fourth plane being coplanar in said first position of the platform and said second plane and third plane being coplanar and said first plane and said fourth plane being coplanar in said second position of the platform.

* * * * *